US006170398B1

(12) United States Patent
Rabotinsky et al.

(10) Patent No.: US 6,170,398 B1
(45) Date of Patent: Jan. 9, 2001

(54) SIGNAL TRANSMISSION FUSE

(75) Inventors: Nickolay Iliych Rabotinsky; Vladimir Vasilievitch Furne; Uriy Gennadievitch Pechenev; Igor Vasilievitch Nikitin, all of Dzerzhinsk; Irina Genadievna Beljankina, Mitishty, all of (RU); Ernest L. Gladden, Granby, CT (US)

(73) Assignee: The Ensign-Bickford Company, Simsbury, CT (US)

( * ) Notice: Under 35 U.S.C. 154(b), the term of this patent shall be extended for 0 days.

(21) Appl. No.: 08/920,516

(22) Filed: Aug. 29, 1997

(51) Int. Cl.[7] ..... C06C 5/04
(52) U.S. Cl. ..... 102/275.8; 102/275.9
(58) Field of Search ..... 102/275.8, 275.9

(56) References Cited

U.S. PATENT DOCUMENTS

| | | | | |
|---|---|---|---|---|
| 3,170,402 | | 2/1965 | Morton et al. | 102/70 |
| 3,590,739 | | 7/1971 | Persson | 102/27 |
| 4,290,366 | | 9/1981 | Janoski | 102/202.3 |
| 4,328,753 | | 5/1982 | Kristensen et al. | 102/275.5 |
| 4,493,261 | * | 1/1985 | Simon et al. | 102/275.8 |
| 4,539,909 | * | 9/1985 | Day et al. | 102/275.8 |
| 4,607,573 | | 8/1986 | Thureson et al. | 102/275.8 |
| 4,757,764 | | 7/1988 | Thureson et al. | 102/312 |
| 4,838,165 | * | 6/1989 | Gladden et al. | 102/275.8 |
| 5,048,420 | | 9/1991 | Beck et al. | 102/275.3 |
| 5,166,470 | * | 11/1992 | Stewart | 102/275.8 |
| 5,212,341 | | 5/1993 | Osborne et al. | 102/275.8 |
| 5,243,913 | | 9/1993 | Brent et al. | 102/275.8 |
| 5,317,974 | | 6/1994 | Stewart et al. | 102/275.8 |
| 5,351,618 | | 10/1994 | Brent et al. | 102/275.8 |
| 5,597,973 | | 1/1997 | Gladden et al. | 102/289 |
| 5,616,884 | * | 4/1997 | Solberg et al. | 102/351 |
| 5,837,924 | * | 11/1998 | Austin | 102/275.8 |

FOREIGN PATENT DOCUMENTS

| | | |
|---|---|---|
| 588 635 | 11/1933 | (DE) . |
| 1 194 301 | 6/1965 | (DE) . |
| 0 710 637 A1 | 5/1996 | (EP) . |
| 0 721 866 A1 | 7/1996 | (EP) . |
| 578853 | 7/1946 | (GB) . |
| WO 90/10611 | 9/1990 | (WO) . |
| WO 93/11089 | 6/1993 | (WO) . |

* cited by examiner

*Primary Examiner*—Peter A. Nelson
(74) *Attorney, Agent, or Firm*—Libert & Associates; Victor E. Libert

(57) ABSTRACT

A signal transmission fuse is made of a tube (36) which encases a support tape (14) having a reactive coating (18') which is adhered to one side of the tape by a binder. A method of making the signal transmission fuse includes depositing on the support tape (14) a reactive paint (18) including a binder, which paint dries to form a reactive coating (18'). The coated support tape (14') is then folded, i.e., formed into a channel configuration, to provide an inner concave side of the tape on which the reactive coating (18') has been disposed. The coated support tape is then enclosed, e.g., within an extruded plastic tube (36). One side of the support tape may be made of a first material (14*a*) to which the reactive coating adheres, and a second side may be made of a second material (14*b*) which bonds or adheres to the inner surface (36*a*) of the plastic tube (36) enclosing the coated support tape (14'). The binder causes even high loadings of the reactive coating (18') to adhere to the coated support tape (14') to prevent reactive material migration. The support tape also shields the reactive material from the hot, freshly extruded surrounding plastic tube (36) during manufacture.

16 Claims, 3 Drawing Sheets

B
36
F
F
34
30
14'
32
24b
24
24a
D
14'
22
10
20
16
18
C
14
12
B 36
30
34
32
14'
24b
24
24a
10
14'
18'
22
20
14
12

18'
14'
14b
14a 14a
14b
14a'
14b'
14

36
36a
28

SIGNAL TRANSMISSION FUSE

FIELD OF THE INVENTION

The present invention relates to an improved signal transmission fuse, such as shock tube, of the type used for transmitting a detonation signal and, more particularly, to an improved tape-containing structure of such fuse, and to a method of making the same.

RELATED ART

Signal transmission fuses of the type commonly referred to as shock tube are well-known in the art. U.S. Pat. No. 3,590,739, issued Jul. 6, 1971 to Per-Anders Persson, discloses a hollow elongated plastic tube having a pulverulent reactive substance, which may be constituted by a highly brisant explosive such as PETN, RDX, TNT or HMX, adhered by various means to the interior wall of the shock tube.

U.S. Pat. No. 4,328,753, issued May 11, 1982 to L. Kristensen et al, discloses a low energy fuse in the form of a plastic tube comprised of concentric tubular plies of material on the inner surface of which is disposed a pulverulent reactive material. One of the problems which Kristensen et al seeks to redress is the art-recognized problem of migration of the reactive material powder from the inner surface of the tube to form a loose powder in the tube. Kristensen et al does this by making the inner or sub-tube of a polymeric material, such as an ionomeric plastic of the type sold under the trademark SURLYN by E.I. Du Pont de Nemours and Company ("Du Pont"), to which the pulverulent reactive material will cling. The patentee states that the reactive material will be dislodged substantially only by the shock wave generated by reaction of the explosive powder. While ionomers such as SURLYN plastics provide good adhesion of such reactive material, such ionomers are susceptible to degradation by ultraviolet radiation, have unacceptably high water vapor and oil permeabilities, and are insufficiently tough for field use. Kristensen et al offers as a solution surmounting the sub-tube with an outer tube made of a less permeable and mechanically tougher material such as a polyamide, polypropylene, polybutylene or other such polymer better able than the sub-tube to withstand the environment and the stresses of deploying the fuse at a work site. The reactive material is a powdered mixture of an explosive and aluminum powder and Kristensen et al discloses that the adhesive nature of the sub-tube enables adherence of about 7 grams of explosive powder per square meter of surface of the inner surface of the tube. Test data are presented that show dislodgment by mechanical forces of about 3 to 61 percent by weight of the amount of reactive material initially present on the inner surface of the tube, depending on the particular type of SURLYN material used for the sub-tube.

Ionomers of the SURLYN type are also advantageous for deposition of the pulverulent reactive material thereon because they can be reliably extruded at a relatively low temperature of about 185° C. (As described below, the reactive material is deposited on the inner surface of the tube at the tube extrusion head.) A reactive material powder containing a thermally stable explosive such as HMX, which has a degradation temperature of about 275° C., can safely be deposited directly on a plastic which is at or near its extrusion temperature of about 185° C. However, the extrusion temperature of SURLYN plastics is too high to permit use of less expensive explosives such as PETN, which has a melting point of only about 141° C., or even RDX, the 204° C. melting point of which is less than about 20° C. higher than the lowest SURLYN plastic extrusion temperature. The thermally less sensitive explosives, such as HMX, are not only more expensive, but are less sensitive than explosives such as PETN and RDX, therefore reducing the reliability of initiation of the signal transmission fuse.

As is well known in the art, the pulverulent reactive material is introduced into the SURLYN or other ionomer tube at the point at which the tube is being extruded, the reactive material powder normally being fed by gravity concentrically within the parison being pulled from the extrusion head. It has been found that extremely fine particles of such reactive materia are difficult to uniformly and reliably apply by gravity flow. This problem is overcome by using a somewhat larger particle size of the reactive material, but the larger particle size results in aggravating the problem of migration of the powder from the tube surface because the larger particles, being heavier, adhere less well to the tube inner surface.

The use of a larger particle size of the reactive material also tends to reduce the sensitivity of the reactive material to initiation, thereby requiring depositing somewhat heavier loadings of the reactive material powder which, in turn, further aggravates the powder migration problem.

Powder migration is a problem because, in products where lengths of the signal transmission fuse are connected to devices such as detonators, migrating powder can collect atop the explosive or pyrotechnic contained within the detonator and shield the explosive or pyrotechnic from the signal generated in the shock tube, thereby resulting in a misfire. Further, deployment of a shock tube in the field results in bends and kinks in the shock tube, and a collection of migrated powder can block the shock tube at such bends or kinks, thereby interrupting transmission of the signal and also resulting in misfire. Of course, if powder migration is so severe as to leave sections of the fuse with insufficient powder adhered thereto to sustain the reaction, a misfire will occur.

Despite the problem of powder migration, the art has persisted in using a loose pulverulent reactive material in signal transmission fuses such as shock tube, deflagrating tube and the like, because it is believed that the reactive material, which is believed to be retained on the ionomer only by Van der Waals forces or the like, must be dislodged at the point of reaction so that it can react, in a manner analogous to a dust explosion, to sustain the reaction and transmit it through the entire length of the tube.

Russian Patent 2,005,984 of Pechenev et al, entitled "Initiating Waveguide", discloses a signal transmission fise (which is referred to as "an initiating waveguide" in the translation of the Russian Patent). The Patent discloses applying the reactive mixture ("explosive") on a film at a core loading of 5 to 40 g/m$^2$, the film being enclosed within a surrounding sheath or tube "with a gap of 0.5 to 7 mm". The Russian Patent thus provides a film or tape to which an explosive powder is applied and which is then encased within a surrounding tube to provide the finished "initiating wave-guide" or signal transmission fuse.

U.S. Pat. No. 4,290,366, issued Sep. 22, 1981 to F. B. Janoski, discloses a signal transmission tube within the bore of which is disposed a self-oxidizing material which extends substantially throughout the length of the tube. The self-oxidizing material may comprise a monofilament or a multifilament of fine, hair-like strands of material that loosely fills the flexible tubing and which may carry explosive modifying materials to alter the density and/or detonation rate of the self-oxidizing material.

The prior art also uses, as a fuse, cotton strings or cords coated with black powder and contained within a hollow plastic tube. The black powder is mixed with a binder to adhere it to the strings or cords.

The present invention provides a fuse structure and method of making a fuse which overcomes the foregoing problems.

SUMMARY OF THE INVENTION

Generally, in accordance with the present invention, there is provided a signal transmission fuse in which a support tape has a reactive material containing a binder coated onto the tape. The reactive material, which may comprise known explosive/fuel mixtures or deflagrating compositions, or a mixture thereof, may be applied to the tape in the form of a reactive paint comprising the pulverulent reactive material, a binder and, optionally, a solvent. The coated tape is then encased within a tube, which may be a plastic (synthetic organic polymeric) tube, which is extruded or otherwise applied over the tape, so that the support tape separates the coating of reactive material from the, for example, hot, freshly extruded, plastic tube. The reactive material is thereby protected from contact with the hot, freshly applied outer tube and this gives more flexibility in selecting both the reactive material and the plastic because the degradation temperatures (defined below) of the components of the reactive material, such as an organic explosive, and the temperature at which the plastic tube is applied, are no longer constraining factors. The utilization of a binder retains the reactive material on the tape during manufacture and, in the finished product, prevents migration of the reactive material through the signal transmission fuse and enables the use of greatly increased core loadings of the reactive material. The increased core loadings may be made high enough so that, when an explosive/fuel mixture is employed as the reactive material, the signal transmission fuse is desirably ruptured upon use.

Specifically, in accordance with the present invention, there is provided a signal transmission fuse comprising the following components. A tube has a longitudinal axis and a tube wall which defines a tube outer surface and a tube inner surface, the tube inner surface defining a bore extending through the tube. A support tape has a first side and an opposite second side and a reactive coating on the first side of the support tape. The reactive coating comprises a reactive material (for example, a pulverulent mixture of an organic explosive and an oxidizable fuel, and/or a pulverulent deflagrating mixture) and a binder. The weight of binder in the reactive coating is less than the weight of the reactive material in the reactive coating, but sufficient to cause the reactive coating to adhere to the first side of the support tape more strongly than it would if the binder were absent. The support tape is disposed within, and extends along the bore of the tube, with the second side of the support tape facing the tube inner surface, and leaves an open portion of the bore extending through the tube adjacent to the reactive coating.

In one aspect of the present invention, the support tape is configured as a channel so that, in cross section, the first side of the support tape is of concave configuration and the second side of the support tape is of convex configuration.

In another aspect of the present invention, substantially all of the second side of the support tape is disposed in contact with the tube inner surface.

Other aspects of the present invention provide for particular reactive materials, as described below, to be applied with a suitable binder as a coating on the support tape.

Still other aspects of the present invention provide for the support tape to comprise a laminate tape in which the first side is comprised of a material, e.g., polyethylene terephthalate, to which the reactive coating is adherent and the second side is comprised of a material, e.g., polyethylene, which is adherent to the tube inner surface.

Yet another aspect of the present invention provides for the tube, or at least the inner surface thereof, to be comprised of a synthetic polymeric material and at least the second side of the support tape to be comprised of a synthetic polymeric material which is bondable to the tube inner surface. For example, in one embodiment of the invention, at least the inner surface of the tube and at least the second surface of the support tape are each comprised of mutually bondable, or the same, or chemically identical, synthetic organic polymers.

A method aspect of tie present invention provides for making a signal transmission fuse by the following steps. There is provided a support tape having a first side and an opposite, second side. A reactive coating comprising a binder and a pulverulent reactive material (which may be one or both of an explosive/fuel mixture or a deflagrating composition) is applied to the first side of the support tape to provide a coated support tape having a reactive coating on the first side thereof. The coated support tape is then formed into a channel configuration to provide it with, in cross section, a convex exterior defined by the second side and a concave interior defined by the first side of the support tape. A tube, for example, a synthetic polymeric tube, is applied over the formed support tape, the tube having a tube inner surface which faces the second side of the formed support tape and defines a bore extending through the tube and within which bore the formed support tape is contained. The concave interior of the folded support tape defines an open portion of the bore which extends longitudinally through the tube adjacent to the reactive coating.

In another aspect of the present invention, the support tape may be supplied at a temperature (including ambient temperature) which is below the degradation temperature (as defined below) of a reactive material comprising an explosive and a binder. For example, the support tape may be supplied at a temperature which is at least 20° to 30° C. below the degradation temperature of the reactive material, e.g., the tape may be supplied at ambient temperature.

Another method aspect of the present invention provides for the reactive coating to be applied as a reactive paint comprising the pulverulent binder, the pulverulent reactive material and a solvent, and the solvent is evaporated to provide the reactive coating.

In one aspect of the present invention the method includes placing substantially all of the second side of the support tape in contact with the inner surface of the tube.

Another aspect of the present invention includes applying the reactive coating to the support tape as a reactive paint comprising the pulverulent binder, the pulverulent reactive material and a solvent, and evaporating the solvent to provide the reactive coating.

In specific aspects of the method of the invention, the specific materials mentioned above are used to produce the signal transmission fuse.

Other aspects of the invention will be apparent from the following description of specific embodiments thereof.

Unless specifically otherwise stated, as used herein and in the claims, the following terms have the indicated meaning.

The term "% by weight" or the like used with respect to a particular component of the reactive coating or otherwise, means the weight of the component as a percent of the total weight of the reactive coating or other material, including the particular component, on a dry (solvent-free) basis.

Term "organic explosive" means a nitro-organic compound explosive such as PYX, HNS, RDX, PETN, ect. (These abbreviations, and others, are defined below.)

The terms "channel", or "channel configuration", or "channel-like configuration" used to describe the support tape, means that the support tape is formed or folded to have a convex exterior and concave interior, and the terms include channels which are U-shaped in cross section ("open channel") and O-shaped in cross section ("tunnel").

The term "degradation temperature", e.g., as applied to a material such as a reactive material, reactive coating, reactive paint or components thereof, means that temperature at or above which desired properties of the material will be adversely affected, e.g., the material or a component thereof may melt or otherwise be adversely affected.

BRIEF DESCRIPTION OF THE DRAWINGS

FIG. 1A is a schematic elevation view illustrating the manufacture of a signal transmission fuse in accordance with one embodiment of the present invention;

FIG. 1B is a plan view taken along line B—B of FIG. 1A;

FIG. 1C is a view, enlarged relative to FIG. 1A, of the portion of the support tape enclosed within the area C of FIG. 1A;

FIG. 1D is a view enlarged relative to FIG. 1A of the portion of the coated support tape enclosed within the area D of FIG. 1A;

FIG. 1F-1 is a view corresponding to that of FIG. 1F but with the tape support omitted therefrom to more clearly show the tube inner surface;

DETAILED DESCRIPTION OF THE INVENTION AND SPECIFIC EMBODIMENTS THEREOF

Reference is made here in and in the claims to explosives including, in addition to 2,6-bis(picrylamino)-3,5 dinitropyridine ("PYX") and ammonium perchlorate, the organic explosives (nitrated organic compounds) "HNS", "PYX", "K-6", "TNT", "ANTIFAN", "PETN", "HMX", "OCTANIT" and "RDX". The foregoing art-recognized abbreviations, as used herein and in the claims, have the meanings set forth below. In addition, as used herein and in the claims, 2,6-bis(picrylazo)-3,5 dinitropyridine is abbreviated as "PADP". "HNS" is hexanitrostilbene ($C_{14}H_6N_6O_{12}$). "K-6" is hexogen carbonyl. (Hexogen, also known as cyclonite or RDX, is described below.) "TNT" is 2, 4, 6-trinitrotoluene. "ANTIFAN", also known as HNTPA, is 2, 4, 6, 2', 4', 2", 4" heptanitrotriphenylamine. "PETN" is pentaerythritol tetranitrate. "HMX", also known as octogen, is cyclotetramethylene tetranitramine. "OCTANIT" is 2,2", 4,4', 4", 6,6', 6" octanitro m-terphenyl ($C_{18}H_6N_8O_{16}$). "RDX", also known as cyclonite or hexogen, is cyclo-1,3, 5-trimethylene-2,4,6-trinitramine. It will be noted that these are high brisance explosives and typically they will comprise from about 52 to 92 percent by weight of the combined weight of explosive and fuel in an explosive-containing reactive material.

Figures 1, 1A, 1B, 1C, 1D, 1F:
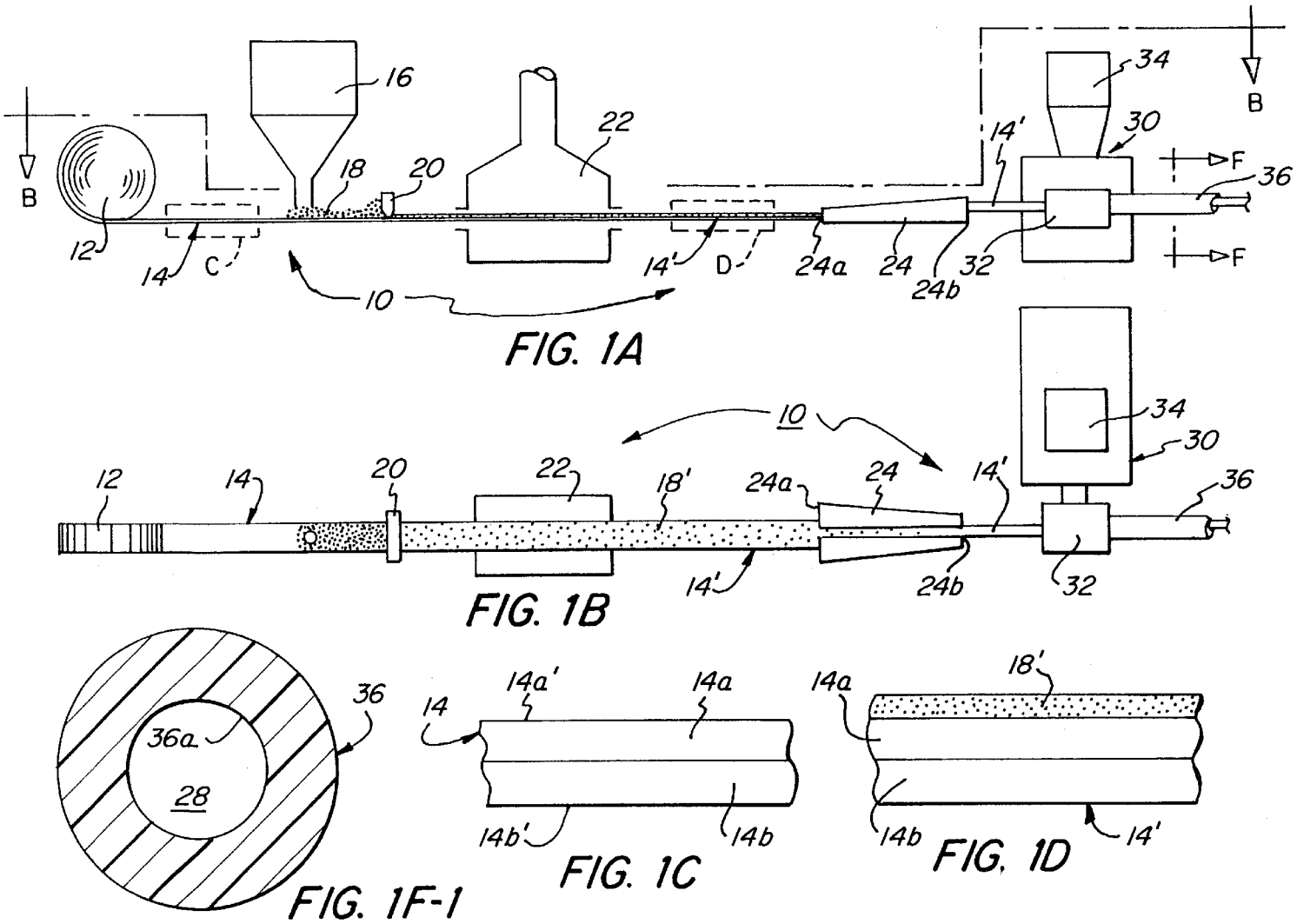

Referring to FIGS. 1A and 1B, there is shown schematically a production line 10 for the manufacture of a signal transmission fuse in accordance with an embodiment of the present invention. Production line 10 includes a roll 12, from which a length of support tape 14 is unwound for passage beneath a hopper 16, within which is stored a reactive paint 18 which is dispensed onto tape 14.

Reactive paint 18 comprises a reactive material admixed with a binder. For example, reactive paint 18 may comprise a pulverulent mixture of aluminum or other oxidizable material (fuel) and PETN or other suitable explosive particles in admixture with a binder such as nitrocellulose or phenolformaldehyde resin, urethane rubber or butadiene-nitrile rubber. In addition, a suitable solvent such as acetone may be included in the reactive paint to attain the proper flowable consistency. Alternatively, reactive paint 18 may comprise a binder, a solvent and a suitable deflagrating composition, as described in more detail below.

A doctor blade 20 smoothes the applied reactive paint into a smooth, uniform coating on support tape 14, which is then transported through a dryer 22, in which any solvent contained in the reactive paint is evaporated and recycled and the reactive paint is dried to form a dried coating 18'.

Support tape 14 may be made of any suitable material, usually a synthetic polymeric material such as polyethylene. In one embodiment, as illustrated in FIG. 1C, support tape 14 is of laminate construction comprising a layer of a first material 14*a* laminated and bound to a layer of a second material 14*b*, so that the first side 14*a*' of support tape 14 is comprised of first material 14*a*, and the opposite, second side 14*b*' of support tape 14 is comprised of second material 14*b*. First material 14*a* comprises a material to which dried reactive coating 18' will firmly adhere and not separate therefrom during subsequent manipulation of the coated support tape 14 as described below. Second material 14*b* comprises a material which will adhere well to the inner surface of the tube to be formed about support tape 14, also as described below. In one embodiment, the first material 14*a* comprises polyethylene terephthalate and the second material 14*b* comprises polyethylene. These materials will readily bond to each other to form a strong, laminated support tape 14, and the reactive coating 18' (FIG. 1D) will strongly adhere to the polyethelene terephthalate first side 14*a*' (FIG. 1C). The tube, or at east the inner surface thereof, which is used to enclose the formed, coated support tape 14', will be made of a material which is readily bondable to second material 14*b*. For example, when second material 14*b* comprises polyethylene, at least the inner surface of the enclosing tube may also be made of polyethylene, as described more fully below.

Figures 1E, 1F, 1G, 2, 3:
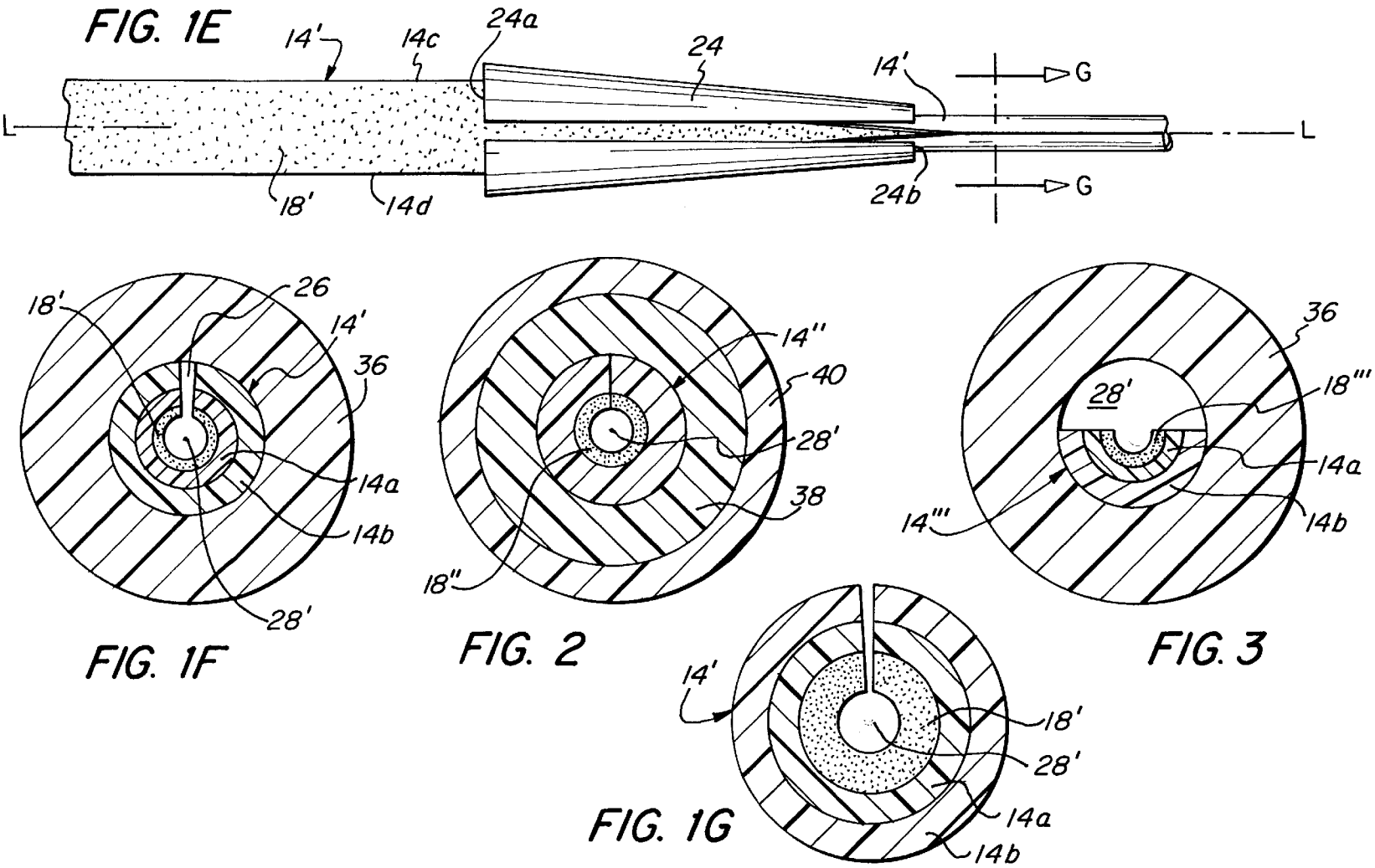
FIG. 1E is a plan view, enlarged with respect to FIG. 1B, of folding die 24 of FIG. 1B.
FIG. 1F is a cross-sectional view taken along line F—F of FIG. 1A showing an embodiment of the signal transmission fuse in accordance with the present invention.
FIG. 1G is a cross-sectional view, enlarged with respect to FIG. 1E, taken along line G—G of FIG. 1E.
FIG. 2 is a view corresponding to FIG. 1D of a signal transmission fuse in accordance with a second embodiment of the present invention.
FIG. 3 is a view corresponding to FIG. 1D, of a signal transmission fuse in accordance with a third embodiment of the present invention.

After leaving the dryer 22, coated support tape 14' is fed to a folding die 24, which, as best seen in FIG. 1E, folds up the edges 14*c*, 14*d* of coated support tape 14' about its longitudinal axis L—L. Folding die 24 has an entry end 24*a* which, as seen in the plan view of FIG. 1E, is wider at its entry end 24*a* than its discharge end 24*b*. As seen in the side elevation view of FIG. 1A, the entry end 24*a* is flat to receive the coated support tape 14', and gradually tapers to a circular discharge end 24*b* at which point coated tape 14' has been folded along its longitudinal axis into a channel configuration, as best seen in FIGS. 1E and 1G.

As shown in FIG. 1G, the channel configuration of coated support tape 14' has its inner surface provided by dried reactive coating 18', which is adhered to a ply of first material 14*a*, which is in turn adhered on its opposite side to, and surrounded by, a ply of second material 14*b*. A small radial gap 26 is left where the opposite edges 14*c*, 14*d* (FIG. 1E) do not quite meet so in this embodiment coated support tape 14" is configured as an open channel, though barely, given the small size of radial gap 26. A longitudinally extending opening 28' is left in bore 28 (FIG. 1F-1) adjacent to reactive coating 18'. The channel configuration of coated support tape 14' has its convex outer surface provided by second side 14*b*' of second material 14*b*.

Referring now to FIGS. 1A and 1B, folded coated support tape 14' is fed to an extruder 30, wherein it enters cross-head die 32 thereof, wherein a tube 36 is extruded about and jackets folded coated support tape 14'. Extruder 30 is supplied with plastic pellets in the known manner via hopper 34 thereof. The resultant structure is best seen in FIG. 1F, wherein tube 36 is seen to encase coated support tape 14' with second material 14*b* of support tape 14' in contact with inner surface 36 a (FIG. 1F-1) of tube 36. As indicated above, the material of tube 36, or at least of that portion thereof which comprises inner surface 36*a,* is selected to be readily and firmly bondable to second material 14*b*. Thus, in a typical construction, tube 36 may be made of polyethylene, second material 14*b* may likewise be polyethylene, and first material 14*a* may be polyethylene terephthalate.

Coated support tape 14' may alternately be formed so that gap 26 is omitted with side edges 14*c* and 14*d* of coated tape 14' brought into engagement with each other to provide the channel as a tunnel configuration, as described in more detail below with respect to FIG. 2.

Hollow tube 36 may be formed by any suitable technique including, in addition to extrusion, spraying, painting, or wrapping tape and/or fibers about coated support tape 14', or by otherwise forming a tube such as tube 36 about the coated support tape 14'.

Another embodiment of the invention is shown in FIG. 2, in which coated support tape 14" is not of laminate construction, but comprises a single, homogenous layer of tape having reactive coating 18" formed thereon. In this embodiment, coated support tape 14" is shown as being formed without a gap equivalent to gap 26 of the embodiment of FIG. 1G to provide the channel configuration as a longitudinal-seam tunnel. In this embodiment, two separate tubes, a sub-tube 38 and an outer tube 40, have been extruded or otherwise applied over coated support tape 14". In this embodiment, sub-tube 38 will be made of a material selected to be bondable to the material of which support tape 14" is made, and outer tube 40 will be selected from another material to provide desired properties, such as tensile strength, toughness, ultraviolet opacity, etc., of the overall construction. Thus, sub-tube 38 may be made of polyethylene and outer tube 40 of a polyamide, polybutylene, or any other suitable material, in order to provide a finished signal transmission fuse having desired qualities. As is well known in the art, a bonding layer (not shown) may be formed between sub-tube 38 and outer tube 40 to insure good adhesion therebetween. It will be appreciated that the two-layer tape of the embodiment of FIGS. 1F and 3 could also be used in the embodiment of FIG. 2, and vice versa, and that any of the illustrated embodiments may employ a single layer tube as in FIGS. 1F and 3, a double layer tube as in FIG. 2, or a three-or-more layer tube (not shown).

In another embodiment of the invention, as illustrated in FIG. 3, coated support tape 14'", which is comprised of a first material 14*a* and a second material 14*b*, is formed into an open channel configuration of shallow U-shape in cross-sectional view. In this embodiment, tube 36 is a single layer or monotube and longitudinally extending opening 28' comprises more than half of the cross-sectional area of bore 28 (FIG. 1F-1 ) of tube 36. Reactive coating 18'" is, as in the other embodiments, disposed on first material 14*a* and exposed to opening 28'.

Generally, the reactive coating, after drying to remove therefrom any solvents contained in the binder or solvents which may optionally be used in formulating the coating, may comprise a combination of a fuel, i.e., an oxidizable material, comprised of powdered aluminum, boron, magnesium, silicon, titanium, zirconium, and/or an oxidizable form of carbon such as charcoal, or a mixture of two or more thereof, together with a pulverulent inorganic or organic explosive such as ammonium perchlorate, potassium perchlorate, potassium nitrate, PADP, HNS, PYX, K-6, TNT, ANTIFAN, PETN, HMX, OCTANIT and/or RDX or mixtures of two or more thereof. An "oxidizable form of carbor." means any carbon or carbonaceous material which is a suitable fuel for the explosive used in the reactive material. The fuel or oxidizable material may be present in an amount of from about 5 to 40% by weight of the total weight of the reactive powder. Fuel content much below 5% by weight reduces the reliability of initiation of the signal transmission fuse from exteriorly of the fuse by conventional detonating caps. On the other hand, if the powdered fuel content exceeds about 40% by weight of the weight of the reactive coating, attenuation of the shock wave generated by reaction of the reactive coating may occur.

About 52 to 92% by weight of the reactive coating is comprised of the powdered explosive and from about 1.5 to 8% by weight of the reactive coating is comprised of a binder.

The binder may comprise any suitable material which will enhance adherence of the reactive powder to the support tape and may comprise, for example, a fluoro-elastomer binder such as those sold under the trademark VITON® by Du Pont, nitrocellulose, polyurethane, butadiene-nitrile rubber, or phenolformaldehyde resin, or mixtures of two or more thereof. It has been found that if the amount of binder present is significantly less than 1.5% by weight of the total weight of the reactive powder, adhesion of the reactive coating to the support tape is poor, and, if the binder is inert to the explosive reaction and the amount of binder in the reactive coating exceeds about 8 % by weight of the total weight, the reactive material is rendered significantly less sensitive and more adherent to the support tape and, therefore, correspondingly more difficult to initiate. Accordingly, reactive coatings in which the binder components are present in the following percent-by-weight amounts are preferred.

| | |
|---|---|
| Binder | about 1.5 to 8% |
| Explosive | about 52 to 92% |
| Fuel (oxidizable material) | about 5 to 40% |

The reactive coating may also contain a suitable inert pulverulent material, i.e., one which does not contribute to the explosive reaction. Alternatively, or in addition, the reactive material may also contain a suppressant to attenuate the force of the explosive material component or the reaction rate of a deflagrating composition. (Deflagrating compositions are discussed below.) For example, an explosive/fuel reactive material may contain an inert pulverulent material with the three above-listed active ingredients being present in the ranges indicated above. For another example, the reaction rate of a deflagrating composition may be reduced by compounding the composition with polymeric compounds such as fluorinated hydrocarbons, vinyl resins and the like, as disclosed in U.S. Pat. No. 4,757,764, issued Jul. 19, 1988 to G. R. Thureson et al. Those skilled in the art will recognize that such ingredients may optionally be added to attain desired signal characteristics.

As is well known in the art, signal transmission fuses of the type with which the present invention is concerned may employ, in lieu of a reactive material containing an explosive, a reactive material containing a deflagrating composition. Signal transmission fuses, often referred to as shock tube, contain a reactive material comprising an explosive and a fuel, and the signal usually propagates through the fuse at a linear velocity of about 1,980 meters per second (about 6,500 feet per second). By selecting reactive materials which comprise deflagrating compositions instead of explosives, signal velocities in the range of from about 30.5 to 1,524 meters per second (about 100 to 5,000 feet per second) may be attained. As disclosed in the aforesaid U.S. Pat. No. 4,757,764, a wide variety of deflagrating compositions are known. Such deflagrating compositions are usable in, or as, the reactive coating of the present invention to produce signal transmission fuses in accordance with the present invention utilizing a deflagrating, rather than an explosive, reactive material. Of course, a combination of explosive and deflagrating compositions may be used. As disclosed in U.S. Pat. No. 4,757,764, the disclosure of which is hereby incorporated herein, such deflagrating materials may comprise a powder mixture of one or more or the following: silicon/red lead ($Si/Pb_3O_4$), molybdenum/potassium perchlorate ($Mo/KClO_4$), tungsten/potassium perchlorate ($W/KClO_4$), titanium hydride/potassium perchlorate ($TiH_2/KClO_4$) and zirconium/ferric oxide ($Zr/Fe_2O_3$). Other suitable deflagrating compositions are boron/red lead ($B/Pb_3O_4$), titanium/potassium perchlorate ($Ti/KClO_4$), zirconium/potassium perchlorate ($Zr/KClO_4$), aluminum/potassium perchlorate ($Al/KClO_4$), zirconium hydride/potassium perchlorate ($ZrH_2/KClO_4$), manganese/potassium perchlorate ($Mn/KClO_4$), zirconium nickel alloys/red lead ($ZrNi/Pb_3O_4$), boron/barium sulfate ($B/BaSO_4$), titanium/barium sulfate ($Ti/BaSO_4$), zirconium/barium sulfate ($Zr/BaSO_4$), boron/calcium chromate ($B/CaCrO_4$), titanium/stannic oxide ($Ti/SnO_2$), titanium hydride/red lead ($TiH_2/Pb_3O_4$), titanium hydride/lead chromate ($TiH_2/PbCrO_4$), and tungsten/red lead ($W/Pb_3O_4$).

As used herein and in the claims, a reactive coating described as comprising a "deflagrating composition", or words to that effect, means and includes any one of the above-enumerated or similar suitable deflagrating compositions. In such case the reactive coating will comprise the binder plus one or more deflagrating compositions.

A reactive paint is comprised of the ingredients of the reactive coating plus a suitable solvent or solvents. The amount of reactive paint which is applied to the tape is varied to attain the desired loading of the reactive coating. Basically, a core loading of from about 5 to 200 grams of reactive coating (dry basis) per square meter of inner surface of the tube may be used. Reference herein and in the claims to the "core loading" means the quantity of reactive coating (dry basis) in grams per square meter of inner surface of the tube which surrounds the folded, coated support tape, e.g., the coated support tape 14' of FIGS. 1F and 1G. The inner surface on which the core loading is based is illustrated by inner surface **36*a* of FIG. 1F-1**. The core loading is expressed as grams per square meter, "$g/m^2$", in the specification and claims. The core loading of the reactive coating obtained from the dried reactive paint may be from about 5 to 40 $g/m^2$, e.g., from about 20 to 40 $g/m^2$. These core loadings are used for explosive-containing reactive coatings (as distinguished from deflagrating composition-containing reactive coatings) if it is desired to limit the reaction force so that, in most cases, the tube of the signal transmission fuse will not be split by passage of the signal therethrough. Where a more energetic reaction is desired, one which will split the tube of most signal transmission fuses, a core loading of an explosive-containing reactive coating of from about 40 to 200 $g/m^2$ may be used. It is sometimes advantageous to have the signal transmission fuse split or rupture upon use, and it will be appreciated that the amount of reactive material which will rupture the fuse depends on the size and strength of the tube, as well as the core loading of the (explosive) reactive material. When the fuse splits and/or breaks, it is less likely to become entangled in earth-moving and other equipment used after blasting at a work site.

Figure 4:
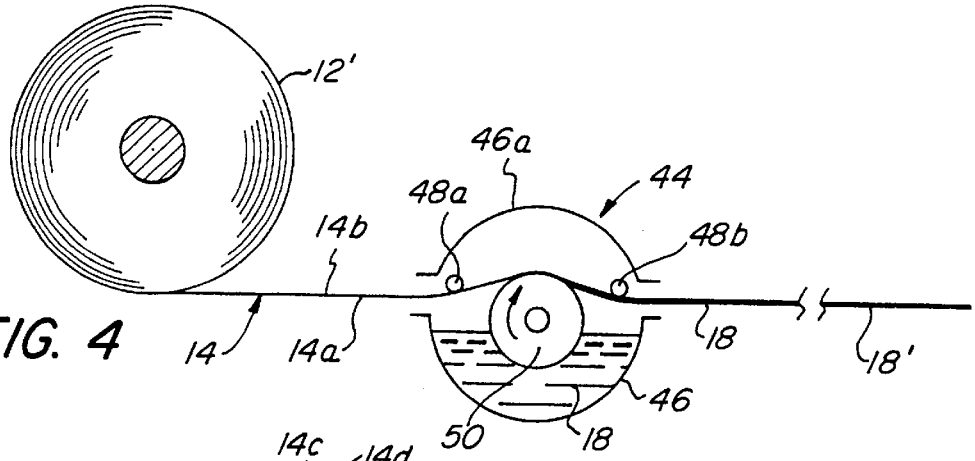
FIG. 4 is a schematic view in elevation of one method of applying a reactive paint to the support tape for purposes of the invention.
Figure 6:
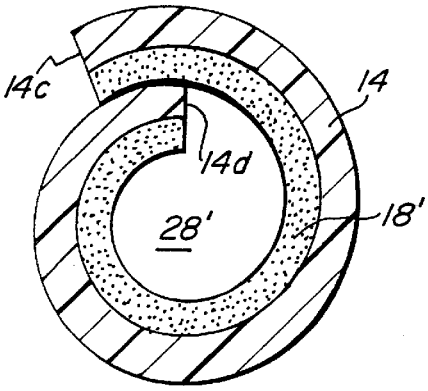
FIG. 6 is a cross-sectional view corresponding to FIG. 1G of a support tape in accordance with another embodiment of the present invention.

The reactive paint may be applied to support tape 14 by any suitable method. One such method is illustrated in FIG. 4, wherein a roll 12' of support tape 14 is fed to a coater 44 comprising a tank 46 and cover **46*a* fitted with openings (unnumbered) through which tape 14 is passed, guided by a pair of rollers 48*a*, 48*b*. A coating drum 50 is mounted for rotation within tank 46 partly submerged within a reactive paint 18 contained within the tank 46. Coating drum 50 rotates in the direction indicated by the unmarked arrow thereon in order to provide a coating of reactive paint 18 to the first side 14*a* of support tape 14. The coated support tape is dried to evaporate the solvent from the paint on the support tape to leave a reactive coating 18' thereon. While coating drum 50 may coat the entire surface of the first side of support tape 14, coating drum 50 may also be configured to apply the reactive paint in any desired pattern onto support tape 14. In this way, some portions of the support tape may be provided with a higher loading of reactive coating than other portions. Such higher loadings may be used to enhance splitting of the tube upon use of the signal transmission fuse. For example, the surface of coating drum 50 which contacts tape 14 may have a raised pattern formed thereon, to apply the reactive paint in a desired pattern. Alternately, or in addition, a series of coating drums may be used, with drying of the reactive paint between drums, to provide more complex patterns of coating on the support tape. For example, instead of forming the support tape in a configuration as illustrated in FIG. 6 (described in more detail below) to provide two layers of reactive coating 18' extending longitudinally along a segment of the formed support tape, a selected longitudinal segment of the support tape may simply have a thicker layer of reactive coating applied thereto. Further, two or more coaters 44** may be employed to apply to the support tape two different types of reactive coatings, and these may, of course, be applied in any selected pattern.

Generally, when the reactive coating is initiated in the known manner, as by spark ignition within the interior of the signal transmission fuse, or by the explosive energy of a detonator cap placed adjacent the exterior of the signal transmission fuse, it is believed, without wishing to be bound by any particular theory, that the reactive coating must be readily released from the support tape upon passage of the shock wave or signal therethrough, in order to maintain the reaction and thereby transmit the signal through the tube. When the reactive material is applied to the support tape at relatively low core loadings, such as from 20 to 40 $g/m^2$, nitrocellulose and phenolformaldehyde resins are well-suited for use as the binder. As higher core loadings, for example, from about 40 to 200 $g/m^2$, such coatings tend to become too brittle, and in the case of such high core loadings, urethane or butadiene-nitrile rubbers, or mixtures thereof with one or more of nitrocellulose and phenolformaldehyde resins, are better suited for purposes of the invention.

Support tape 14 may be supplied at ambient temperature from a roll 12 as illustrated in FIGS. 1A and 1B. After drying in dryer 22, coated support tape 14' may be fed directly to the remainder of the process as illustrated in FIGS. 1A and 1B, or may be taken up in a roll and sent to storage and subsequently be removed from storage for feeding to folding die 24 and the remainder of the process as illustrated in FIGS. 1A and 1B. In other words, it will be appreciated that the process may be begun with a roll of pre-coated support tape 14'.

Alternatively, in lieu of roll 12 of FIGS. 1A and 1B, the manufacture of support tape 14 may be integrated into the process illustrated in FIGS. 1A and 1B by replacing roll 12 with an extruder or other equipment in which support tape 14 is manufactured. In such case, the freshly made tape is preferably cooled, e.g., to ambient temperature, before depositing the reactive paint thereon. In any case, the support tape 14 is supplied at a temperature which is preferably at least about 20° C., e.g., 20° to 30° C., less than the temperature at which tube 36 is extruded or otherwise applied to the support tape 14.

Because support tape 14 may be supplied at ambient temperature, or at a temperature significantly below the temperature at which the support tape and the tube 36 is extruded or otherwise manufactured, the explosives and other ingredients used in reactive paint 18 are not heated to elevated temperatures by being deposited on a freshly extruded plastic, and, therefore, explosives which are heat-sensitive may readily be used in the process because they are deposited on a support tape 14, which may be at ambient temperatures, i.e., at 18 to 21° C. Thus, support tape 14, whether or not it is supplied at ambient temperature, is preferably supplied at a temperature below the melting point of the reactive material and below the degradation temperature of the reactive material, e.g., at a temperature of at least about 20° C. below such degradation temperature. The same applies to reactive compositions which utilize a deflagrating composition, i.e., the support tape 14 will be supplied to the process at a temperature, which may be ambient temperature or higher, but which is below and, preferably, at least about 20° C. below, the degradation temperature of the deflagrating composition. This is in contrast to prior art processes in which the reactive material, usually in the form of a powder, is applied directly to the freshly extruded tube or parison from which the tube is formed as the parison emerges from the extrusion head. (In the prior art techniques, the extrusion head is normally positioned vertically so that the powder may be gravity fed into the parison from which the tube is being formed.) In such cases, a reactive material which is not sensitive to the temperature necessary to melt the plastic being extruded must be employed.

It will be appreciated that the technique of the present invention avoids that difficulty and permits the use of explosive materials, or reactive materials generally, which are so thermally sensitive that they could not be deposited upon freshly extruded uncooled plastic. For example, when the coated tape 14' is folded into a channel configuration, as illustrated in FIG. 1G, the portion of coated support tape 14' which is comprised of materials 14*a* and 14*b* in the embodiment of FIG. 1G thermally shields reactive coating 18' from the hot plastic being used to form tube 36 (FIG. 1F) about coated support tape 14'. It will be appreciated that, although the coated support tape utilized may be freshly made, it nonetheless may, prior to being coated with the reactive material, be cooled to a temperature sufficiently low to avoid any problems with the particular reactive material being coated thereon. Alternatively, the support tape may be made or acquired in advance and the reactive material applied to support tape from storage will, of course, be at ambient temperature. Yet another option is to prepare in advance support tape coated with reactive material and then form the coated support tape into the desired channel configuration and encase it within the tube.

Figure 5:
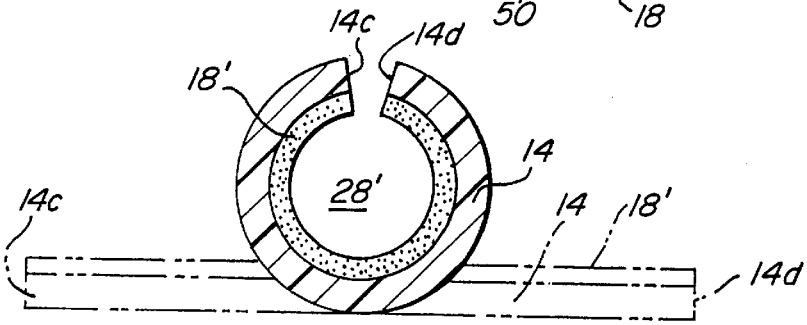
FIG. 5 is an end view showing a section of support tape formed into a channel with the configuration of the tape prior to forming being rendered in phantom outline.

As used herein and in the claims, terms such as "forming the support tape into a channel configuration", or "the support tape is configured as a channel", or words of similar import, simply mean that the support tape is formed or folded to have a channel-like configuration (either an "open channel" or "tunnel" as defined above at the end of the Summary of the Invention) with an inside surface which is concave in cross section, and an outside surface which is convex in cross section. This may be best appreciated with reference to FIG. 5, which illustrates a typical support tape 14 having a typical reactive coating 18' disposed thereon. In FIG. 5, support tape 14 is shown in phantom outline in its flat configuration, and is shown in solid-line rendition after it has been formed into a channel configuration by, in this instance, bringing the opposite longitudinal edges 14*c*, 14*d* thereof towards each other. In FIG. 5, longitudinal edges 14*c*, 14*d* are disposed substantially parallel to each other in parallel to the longitudinal axis of support tape 14. In the configuration shown in solid line in FIG. 5, support tape 14 has a gap as does the coated support tape 14' shown in FIG. 1F. It will be appreciated that by bringing edges 14*c*, 14*d* into abutting contact, a channel configuration comprising a tunnel, as illustrated by coated support tape 14" in FIG. 2 is attained. In all cases, a longitudinally extending opening 28' is maintained.

FIG. 6 shows yet another tunnel embodiment in which the edges 14*c* and 14*d* are brought past each other so that longitudinally extending segments of support tape 14 and reactive coating 18' disposed thereon partially overlap each other to provide overlapped and non-overlapped portions of the support tape. As a result, a longitudinally extending strip segment of the support tape will have two overlying layers of reactive coating 18' on the overlapped portions thereof.

In all cases, it will of course be appreciated that support tape 14 provides a thermal barrier between the tube encasing it, e.g., tube 36 of FIG. 1F, and the reactive coating 18' disposed on the support tape. While, given the typical dimensions of signal transmission fuses of the type with which this invention is concerned, support tape 14 is necessarily quite thin, it may be made thick enough to provide an adequate thermal insulating barrier between reactive coating 18' and the tube 36 when the latter is hot, e.g., by having been freshly extruded.

Figure 7:
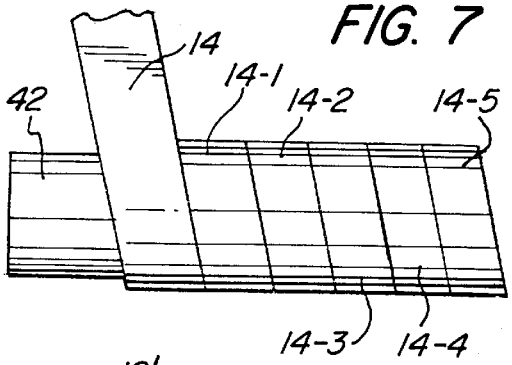
FIG. 7 is a schematic view showing a length of support tape being formed into a channel (tubular) configuration by being wrapped around a mandrel.
Figure 8:
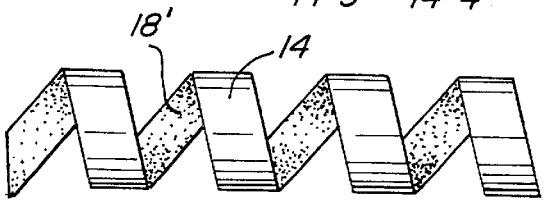
FIG. 8 is a schematic side view of a length of support tape formed into an open, tubular configuration.
Figure 9:
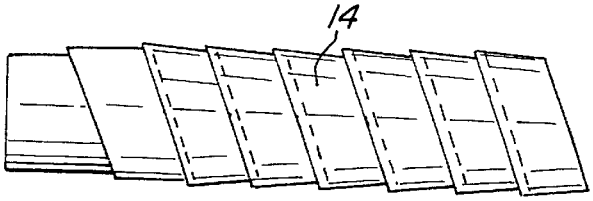
FIG. 9 is a view corresponding to FIG. 8, but showing another embodiment of the invention wherein the support tape is formed into an overlapping tubular configuration.

FIGS. 7–9 show a different technique for forming the support tape into a channel configuration, wherein the channel configurations attained are of the tunnel type (as also illustrated in FIG. 2) rather than an open channel of U-shaped cross-section as illustrated, for example, in FIG. 3. In FIG. 7, support tape 14 is shown being wound about a mandrel 42 to provide a series of adjacent turns 14-1, 14-2, 14-3, 14-4 and 14-5, which adjacent turns abut each other to provide a channel configuration of the closed tunnel type. Reactive coating 18' (not seen in FIG. 7) is adhered to the first or inside surface of the tubular configuration of support tape 14. The reactive coating is held firmly enough on support tape 14 by the binder component thereof so that the reactive coating is not abraded off the support tape by passing over mandrel 42. However, in order to reduce or eliminate abrasion losses of the reactive coating, it is preferable to form the channel configuration illustrated in FIG. 7 not by the illustrated mandrel 42, but by a die, such as folding die 24 (FIG. 1E), which acts on the second or outside and uncoated surface of support tape 14.

FIG. 8 illustrates another embodiment in which support tape 14, having reactive coating 18' thereon, is formed into a channel configuration of the tunnel type, but in which the adjacent turns (the turns are not separately numbered in FIG. 8) are spaced apart from each other to provide an open tunnel configuration. FIG. 9 illustrates a support tape 14 formed into a channel configuration of the tunnel type in which the adjacent turns (which are not separately numbered in FIG. 9) overlap each other to provide an overlapped tunnel configuration. With a given loading of reactive coating 18' disposed on the support tape 14 in FIG. 7–9, the open tunnel configuration of FIG. 8 will provide the lowest core loading of reactive material, whereas the closed tunnel configuration of FIG. 7, with the edges of adjacent turns abutting each other, will provide an intermediate core loading, and the overlapped tunnel configuration of FIG. 9, with the adjacent turns overlapping each other, will provide the highest core loading of the three arrangements of FIGS. 7–9. By using such configurations, a single premanufactured support tape may be used for signal transmission fuses of different core loadings.

Regardless of the pattern of distribution of the reactive coating, which may, of course, be uniformly distributed on the support tape, if desired, the amount of reactive material core loading utilized may be selected to be high enough, usually 40 g/m$^2$ or higher, so that upon initiation of the signal transmission tube, the force of the reaction ruptures tube 36. This is advantageous, as by rupturing tube 36 the "carcass" of the expended signal transmission fuse is split and greatly reduced in tensile strength, which reduces the possibility of the carcass becoming entangled with equipment. Further, by rupturing the signal transmission tube, it becomes immediately apparent that the carcass is that of an expended tube and is not unexpended signal transmission fuse.

The following Examples illustrate particular embodiments of the invention.

EXAMPLE 1

Explosive compositions comprising the reactive paints listed in TABLE I were applied to a two-layer support tape of polyethylene terephthalate and polyethylene, 5 mm in width, at a core loading of 20 to 40 g/m$^2$, approximately equivalent to a linear core loading of 100 to 200 mg/m. The support tape was approximately 0.1 mm in thickness, the polyethylene terephthalate layer being 0.05 mm thick and the polyethylene layer being 0.05 mm thick. One of the reactive paints was applied to the polyethylene terephthalate side of a sample tape and dried to provide a dried coating.

TABLE I

Embodiments of Explosive Coating Compositions

| | % by Weight Composition No. | | | | |
|---|---|---|---|---|---|
| Components | 1 | 2 | 3 | 4 | 5 |
| HMX | — | 39 | 72 | — | 30 |
| RDX | — | 39 | — | 58 | 49 |
| PETN | 72 | — | — | — | — |
| Nitrocellulose | 8 | 6 | — | 3 | 4 |
| Phenolformaldehyde resin | — | — | 4 | 1 | 1 |
| Aluminum powder | 20 | 16 | — | 38 | — |
| Titanium powder | — | — | 24 | — | 16 |

The coated support tape is formed into a tubular or folded configuration with the polyethylene side on the exterior of the tubular or folded configuration and bonded to the inner surface of a tubular polyethylene sheath extruded about the folded, coated support tape. The extruded polyethylene tube had an inside diameter of 1.8 mm and an outside diameter of 4.0 mm. The folded, coated tape enclosed within the polyethylene tube had an open space of about 0.65 mm diameter extending along the length thereof so that the dried coating is exposed to air along the length thereof.

A 10 meter length of each of the resulting signal transmission fuses was initiated by a standard Number 6 detonator, one of which was taped to the end of each of the samples and initiated. All the samples were successfully initiated and in each case a longitudinal slot fracture was formed along the length of the polyethylene tube.

EXAMPLE 2

An explosive composition of each of the reactive paint compositions 1–4 of TABLE II, having various core loadings in the range of 40 to 200 g/m$^2$, was applied to the polyethylene terephthalate side of a two-layer film of polyethylene terephthalate and polyethylene, 6 mm in width and 0.1 mm thick, the polyethylene terephthalate layer being 0.05 mm thick and the polyethylene layer being 0.05 mm thick. The coated tape is formed into a tape support with the polyethylene side on the exterior, and is bonded to the inside surface of a tubular polyethylene sheath as the tube is extruded about the tape support.

The polyethylene tube had an inside diameter of 2.0 mm and an outside diameter of 3.8 mm. An open space of about 0.28 mm diameter remained between the reactive coating on the support tape and the inner surface of the polyethylene tube. The open space extended along the length of the tube so that the dried coating was exposed to air along the length thereof.

A 10 meter length of each of the resulting signal transmission fuses was initiated by a standard Number 6 detonator, one of which was taped to the end of each of the samples and initiated, thereby initiating a reaction in the base of the shock tube. All the samples were initiated and a longitudinal fracture with ragged edges was formed along the length of the polyethylene tube in the sheath.

TABLE II

Embodiments of Explosive Coating Compositions

| Components | % by Weight Composition No. 1 | 2 | 3 | 4 |
|---|---|---|---|---|
| HMX | 77 | — | — | — |
| RDX | — | 71 | 15 | — |
| Hexogen carbonyl | — | — | 61 | 82 |
| Butadiene-nitrile rubber | — | — | 3 | — |
| Urethane rubber | 2 | 4 | — | 2 |
| Phenolformaldehyde resin | 1 | — | 1 | — |
| Aluminum powder | 20 | — | 20 | 16 |
| Charcoal | — | 25 | — | — |

While the invention has been described in detail with respect to specific preferred embodiments thereof, it will be apparent to those skilled in the art that upon a reading and understanding of the foregoing, numerous alterations may be made thereto without departing from the spirit and scope of the present invention.

What is claimed is:

1. A signal transmission fuse comprising:

a tube having a longitudinal axis, a tube wall defining a tube outer surface and a tube inner surface, the tube inner surface defining a bore extending through the tube; and a support tape having a first side and an opposite second side, the first side having thereon a reactive coating comprising a reactive material and a binder, the binder being present in the reactive coating in an amount by weight less than the weight of the reactive material but sufficient to cause the reactive coating to adhere to the first side of the support tape more strongly than it would if the binder were absent;

wherein the support tape is disposed within and extends along the bore of the tube with the second side of the support tape facing the tube inner surface, and an open portion of the bore extending through the tube adjacent to the reactive coating.

2. The signal transmission fuse of claim 1 wherein the support tape is configured as a channel whereby, in cross section, the first side of the support tape is of concave configuration and the second side of the support tape is of convex configuration.

3. The signal transmission fuse of claim 2 wherein substantially all of the second side of the support tape is disposed in contact with the tube inner surface.

4. The signal transmission fuse of claim 1 or claim 2 wherein the reactive coating comprises a binder, an explosive and an oxidizable fuel.

5. The signal transmission fuse of claim 4 wherein the binder comprises from about 1.5 to 8%, the explosive comprises from about 52 to 92%, and the oxidizable fuel comprises from about 5 to 40% by weight of the reactive coating.

6. The signal transmission fuse of claim 4 wherein the explosive is selected from the group consisting of one or more of ammonium perchlorate, PADP, HNS, PYX, K-6, TNT, ANTIFAN, PETN, HMX, OCTANIT and RDX, and the fuel is selected from the group consisting of one or more of aluminum, boron, magnesium, silicon, titanium, zirconium and an oxidizable form of carbon.

7. The signal transmission fuse of claim 6 wherein the reactive coating is present in a core loading of from about 5 to 200 $g/m^2$.

8. The signal transmission fuse of claim 7 wherein the binder is selected from the group consisting of one or more of fluoroelastomers, urethane rubber, butadiene-nitrile rubber, nitrocellulose, phenolformaldehyde resin, polyvinyl butyral and polyvinylacetate.

9. The signal transmission fuse of claim 1 or claim 2 wherein the support tape comprises a laminate tape in which the first side is comprised of a material to which the reactive coating is adherent and the second side is comprised of a material which is adherent to the tube inner surface.

10. The signal transmission fuse of claim 1 or claim 2 wherein at least the tube inner surface is comprised of a synthetic polymeric material and at least the second side of the support tape is comprised of a synthetic polymeric material which is bondable to the tube inner surface.

11. The signal transmission fuse of claim 1 or claim 2 wherein at least the inner surface of the tube and at least the second surface of the support tape are each comprised of a chemically identical synthetic organic polymer.

12. The signal transmission fuse of claim 1 or claim 2 wherein the support tape comprises a laminate of a layer of polyethylene terephthalate and a layer of polyethylene, the first side being comprised of the layer of polyethylene terephthalate and the second side being comprised of the layer of polyethylene.

13. The signal transmission fuse of claim 2 wherein the support tape has a tubular configuration.

14. The signal transmission fuse of claim 2 wherein at least a portion of the support tape is overlapped to provide overlapped portions thereof.

15. The signal transmission fuse of claim 14 wherein the reactive coating is disposed on the overlapped portions whereby at least a portion of the support tape has overlying layers of the reactive coating.

16. The signal transmission fuse of claim 1 or claim 2 wherein the reactive coating is applied to the support tape in a pattern to provide selected areas on the support tape with a higher loading of reactive coating than is present on other areas of the support tape.

* * * * *